United States Patent [19]

Sanders

[11] 4,403,543

[45] Sep. 13, 1983

[54] BALING DEVICE

[76] Inventor: Lovett Sanders, 1216 W. Walnut St., Milwaukee, Wis. 53205

[21] Appl. No.: 374,354

[22] Filed: May 3, 1982

[51] Int. Cl.[3] ..... B65B 13/20

[52] U.S. Cl. ..... 100/34; 100/98 R; 100/233; 100/266

[58] Field of Search ..... 100/2, 8, 12, 33, 34, 100/233, 266, 98 R

[56] References Cited

U.S. PATENT DOCUMENTS

| | | | |
|---|---|---|---|
| 920,541 | 5/1909 | Chesson | 100/233 X |
| 1,037,781 | 9/1912 | Longdon | 100/7 |
| 3,082,682 | 3/1963 | Kaufman | 100/3 |
| 3,139,814 | 7/1964 | Sanders | 100/34 |
| 3,388,422 | 6/1968 | Benoit | 100/233 X |

FOREIGN PATENT DOCUMENTS

| | | | |
|---|---|---|---|
| 1079534 | 4/1960 | Fed. Rep. of Germany | 100/34 |

*Primary Examiner*—Billy J. Wilhite
*Assistant Examiner*—Christine A. Peterson
*Attorney, Agent, or Firm*—Wheeler, House, Fuller & Hohenfeldt

[57] ABSTRACT

Device for baling scrap such as corrugated paper cartons and the like, including a pointed spindle extending upwardly through a support platform. The point of the spindle is detachable from the spindle shaft, and supports tie strings routed from beneath the support platform. A baling lever disposed above the support platform is drawn downward from its rest position toward the spindle to impale scrap on the spindle; an accumulation of impaled material on the spindle forms a stack to be baled. The spindle is linked to a vertically movable spindle support lever beneath the platform; the support lever is normally latched in its uppermost position to support the spindle in its operative position. When the stack of material is to be bound into a bale, the point of the spindle is detached and the spindle support lever is released and lowered, withdrawing the spindle shaft from the stack of material and leaving the strings threaded through the stack. The baling lever is adjustably spring-loaded to facilitate its return to its rest position.

7 Claims, 5 Drawing Figures

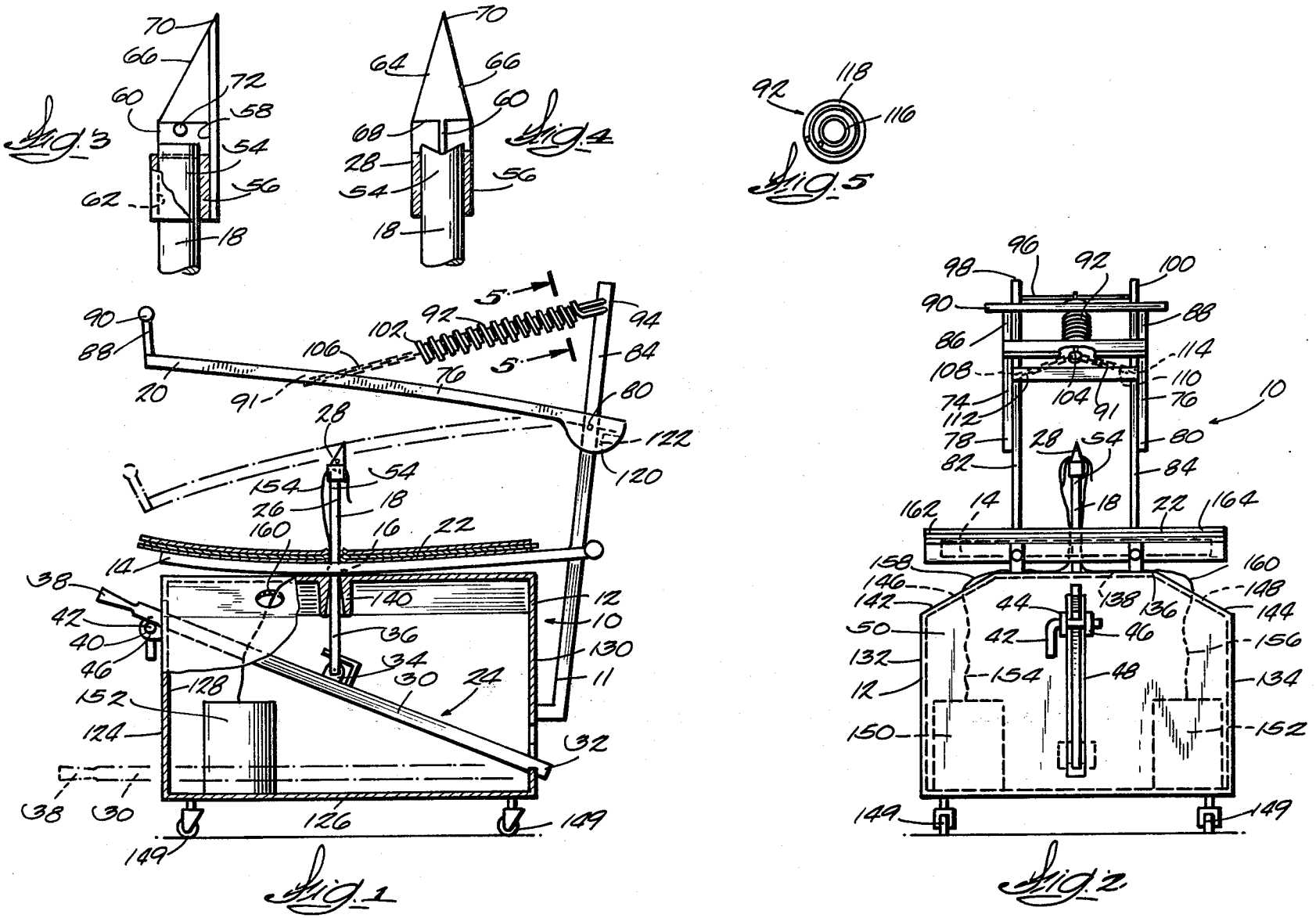

BALING DEVICE

TECHNICAL FIELD

The present invention is a scrap baling device for crushing corrugated paper cartons and the like and accumulating the crushed material to form stacks which ar bound into bales and then easily disposed of. Devices of this type comprise a support platform, a pointed spindle extending upward through the platform on which materials are impaled to form a stack, an impaling press, and baling means for threading tie strings through the hole impaled in the stack of material.

BACKGROUND OF THE INVENTION

This device is an improvement of the device shown in U.S. Pat. No. 3,139,814, issued to me on July 7, 1964 and incorporated herein by reference to show the state of the art. That device was effective but was in some respects less satisfactory than the present improved device. The entire spindle had to be released and pulled upwardly through the stack, which was awkward and difficult, to thread the strings and release the bale. The detached spindle then had to be put down somewhere and the string cut from it and tied about the bale. Also, after one bale was removed, the tie strings for the next bale had to be brought up over the frame of the machine and tied to the lower end of the spindle to set the device up for continued baling. Also, if the baling press lever in the previous device was released to return to its rest position, the upward bias of its spring caused it to strike its stop abruptly, and nothing prevented the fingers of a careless user from being crushed between the baling press lever and the fixed stop which limited upward travel of the press lever.

SUMMARY OF THE INVENTION

The present baling press has several improved features. The first is a movable support lever for supporting the spindle from beneath the support platform. The support lever is usually latched in place to support the spindle in its operating position. When a stack has been formed and is to be removed from the spindle, instead of pulling the spindle upwardly to pull the string up through the bundle the operator simply unlatches the support lever and moves it to its lower position to draw the spindle down through the bundle, assisted by the substantial weight of the lever. Usually it is not necessary to push downward on the support lever.

A second improvement is the manner in which one or more tie strings are threaded through the hole impaled in the stack of material. Before impalement begins tie strings are dressed upward through the machine to a hole or a pair of holes in the point of the spindle; the point is detachable. Before the support lever is lowered as just described, the spindle point, to which the tie strings are secured, is removed from the spindle shaft and set down on the top of the stack. The strings remain dressed through the stack, and can easily be tied to loops of the strings recovered from beneath the support platform to provide a secure bale. The string may then be cut and the new free end secured to the point.

Another improvement is in the structure of the string storage housing located beneath the support platform. The upper wall of the housing has downwardly inclined marginal surfaces, each provided with an access hole through which a string is threaded. The inclined surfaces provide access to a loop of string from beneath a stack of material on the support platform.

A fourth improvement is that the return spring for the baling press lever has been modified. The spring has been positioned above the arm and has been secured to the press lever with a link chain or other member having an adjustable length. The chain is adjusted to support the press lever a rest position just short of its stop, preventing the press lever from abruptly striking its stop when released. Furthermore, the position of the spring provides a better mechanical advantage and allows less expensive springs to be used. In addition, a second spring has been provided inside the first with a separate connection to the arm, so that should either spring break there will still be emergency support for the press lever.

Still another improvement is that ears depend from the baling press lever in its pivot region adjacent the lever stops to prevent the operator or others from having their fingers caught between the stops and nearby portions of the baling arm.

BRIEF DESCRIPTION OF DRAWINGS

FIG. 1 is a side elevational view of one embodiment of my invention with the lower portions broken away to show interior structure.

FIG. 2 is an end elevational view of the device of FIG. 1.

FIG. 3 is an enlarged, broken away detail view of FIG. 1, showing the spindle point.

FIG. 4 is an enlarged, broken away detail view of FIG. 2, showing another view of the spindle point.

FIG. 5 is a cross-sectional view taken along line 5—5 of FIG. 1.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. While the best known embodiment has been described, the details may be changed without departing from the invention, which is defined by the claims.

Referring first to FIGS. 1 and 2, the baling device indicated at 10 generally comprises a frame 11, a housing 12 supporting the frame, a support platform 14 supported by the frame, a central opening 16 in platform 14, a pointed spindle 18 extending through opening 16, a baling press lever 20 for impaling a stack of material 22 on spindle 18, and means generally indicated at 24 for withdrawing spindle 18 from stack 22 when a bale is to be removed from the device.

Spindle 18 comprises a upstanding shaft 26 supporting a detachable wedge-shaped impaling point 28. Shaft 26 is supported from beneath platform 14 by a support member, here a lever 30 pivoted at its first end 32 to housing 12, pivoted at a centrally disposed lug 34 to the lower extremity 36 of shaft 26, and having its second end 38 projecting from the front of the frame as a handle. Second end 38 is usually supported in its raised position (shown in full lines) by a latch 40, here comprising a removable pin 42 received through a registered pair of holes in lugs 44 and 46 located on the respective sides of a vertically disposed slot 48 in housing 12. If pin 42 is withdrawn from lugs 44 and 46, end 38 of support lever 30 will drop within slot 48 to the position shown in phantom in FIG. 1. As a result, spindle shaft 26 will be withdrawn axially through central opening 16. When shaft 26 is fully withdrawn its upper end 54 will be within or near central opening 16. Even if stack 22 impaled on shaft 26 is quite bulky, the weight and arrangement of support lever 30 can be such that, when unlatched, it tends to withdraw shaft 26 from stack 22 without requiring any substantial force to be exerted on handle end 38 of lever 30.

Referring now to all the Figures, point 28 comprises a sleeve 56 for slidably receiving upper end 54, a body 58 to which sleeve 56 is attached, a fin 60 extending from body 58 and intersecting the bore 62 of sleeve 56, and converging surfaces such as 64 and 66 of body 58 which eclipse sleeve 56 at their lower edges 68 to allow impaled material to easily pass sleeve 56. The upper terminus of point 28 is sharpened to allow it to easily penetrate materials to be impaled. When support lever 30 is secured by latch 40, point 28 cannot be forced downward from the position shown in the Figures, but point 28 can easily be lifted from upper end 54 of shaft 26. Finally, fin 60 is perforated by an opening 72 for receiving a string, as further described below.

Baling press lever 20 for impaling material on point 28 comprises first and second lever arms 74, 76 respectively having first ends 78, 80 pivoted to upright members 82, 84 forming a part of frame 11. The second ends 86 and 88 of the levers are joined by a handlebar 90, and portions of the levers between their ends are joined by crossbar 91. Press lever 20 is normally maintained in its raised position, shown in full lines in FIG. 1, by a return spring member 92 having a first end 94 secured to a crossbar 96 having its respective ends fixed to the upper extremities 98, 100 of upright members 82, 84. The second end 102 of spring member 92 is secured to a central link 104 of a link chain 106 having its first and second ends 108 and 110 fixed to points of attachment 112, 114 on press lever 20. The effective length of spring member 92 can be varied by securing links of chain 106 other than the end links to points of attachment 112 and 114. In this embodiment return spring member 92 is sufficiently slack that the press lever stops will not ordinarily strike vertical members 82 and 84.

One optional feature of return spring member 92, best seen in FIG. 5, is that it comprises an inner spring 116 and an outer spring 118 attached in parallel (meaning that the corresponding ends of the springs are attached to the same structure). If either spring fails the other will prevent press lever 20 from dropping suddenly, and will also prevent parts of a suddenly broken spring from flying about.

Another feature of the device is that ears such as 120 are provided to shield the stops such as 122 which approach upright members 82 and 84 as press lever 20 is raised, preventing one's fingers from being inserted between the stops and vertical members.

Another new feature of the present invention is the construction of housing 12. Housing 12 comprises a bottom wall 126, front and rear walls 128 and 130, side walls 132 and 134, and a compound top wall 136 having a central surface 138 (including a shaft guide 140 for shaft 26) and opposed marginal surfaces 142, 144 having openings 146, 148, the purpose of which is explaind below. Bottom wall 126 can be equipped with casters 149 to allow baling device 10 to be moved about easily. Containers 150 and 152 for strings 154 and 156 are stored within housing 12.

The baling device just described is used as follows. When not being operated, baling device 10 is arranged as shown in full lines in the figures. Support lever 30 is latched in its raised position, point 28 is supported on upper end 54 of shaft 26, and baling press lever 20 is in its raised position. When a cardboard carton or other waste material is to be crushed and impaled on the device, it is placed between press lever 20 and point 28, and handlbar 90 is pulled down by the operator, causing baling press lever 20 to impale the material on shaft 26. Waste material 22 tends to collect in stack as shown in FIG. 1, although when only a few items are impaled they can be distributed along shaft 26 more than is shown.

When a substantial stack of material 22 has accumulated on shaft 26 and has been suitably compressed, point 28, which supports strings 154 and 156, is removed from shaft 26 and laid on top of stack 22. Handle end 38 of support lever 30 is then released by removing pin 42 from lugs 44 and 46, allowing support lever 30 to drop to its lowered position (shown in phantom). The weight of support lever 30 is sufficient that little or no force need be exerted on handle 38 to lower lever 30. Lowering lever 30 draws shaft 26 downwardly, thus drawing it out of stack 22. When shaft 26 is withdrawn, strings 154 and 156 remain secured to point 28 and threaded through stack 22. The ends of strings 154 and 156 are then cut or untied from point 28, and loops of each string are drawn from the areas adjacent openings 146 and 148 around the respective ends 162 and 164 of stack 22. Each loop is tied to the corresponding string end, forming two string bands which, pass through the impaled part of stack 22 and around an end of the stack. The strings keep the baled stacks from falling apart so they can be stacked up and transported easily. When a bale has been removed, strings 154 and 156 are pulled out of their containers and led up to opening 72, where they are tied or otherwise secured. The strings then pass through each item of waste material as it is impaled.

I claim:

1. In a scrap baling device comprising a frame, a raise support platform provided with a central opening, a pointed spindle extending through the central opening, means for impaling material on said spindle to assemble a stack, means for binding said stack together to form a bale, and means for removing said spindle from said bale, the improvements wherein said spindle has a shaft and a point including means for receiving tie strings, said shaft is supported from beneath said support platform by a support member normally latched at a raised position, and said means for removing said spindle from said bale comprises means for unlatching said support member and moving it to a lowered position, thereby withdrawing said shaft from said stack.

2. The device of claim 1, wherein said spindle has a detachable point comprising a sleeve for receiving said shaft, a fin fixed within the sleeve for bearing against said shaft, upwardly converging surfaces fixed to and disposed above said sleeve to define an impaling wedge, and means for supporting tie strings.

3. The device of claim 1, in which said spindle support member comprises a lever pivoted at a first end to said frame, pivoted at a centrally disposed portion to the spindle shaft, having a second end projecting through the front of said frame, and having a latch to releasably support the second end of said lever in a raised position.

4. The device of claim 1 in which the means for impaling material on said spindle comprises a baling press lever having a handle at one end, a pivotal connection to said frame at the other end, a material engaging portion between said ends, and return spring means having one end connected to said press lever between its ends and the other end secured to said frame above said baling press lever.

5. The device of claim 4, in which the connection between said return spring means and baling press lever comprises a link chain having a central link connected to said spring and end links releasably secured to attachment points on the baling press lever, whereby the effective length of the spring can be changed by connecting said attachment points to links between said end links and central link.

6. The device of claim 5, in which a second spring is disposed within and connected in parallel to the first spring to assist the first spring in normal operation and to prevent the release of said press lever should either spring break.

7. The device of claim 1, in which said frame is supported by a lower housing having a compound top wall disposed beneath said support platform, and in which the opposed marginal surfaces of said housing top wall are downwardly inclined and include openings providing access to a string storage area within said housing, whereby to provide access to a loop of string beneath said support platform when a stack waste material to be baled is on the support platform.

* * * * *